US009777445B1

(12) United States Patent
Engel et al.

(10) Patent No.: US 9,777,445 B1
(45) Date of Patent: Oct. 3, 2017

(54) SCREED ASSEMBLY FOR PAVING MACHINE

(71) Applicant: Caterpillar Paving Products Inc., Brooklyn Park, MN (US)

(72) Inventors: Brett Wayne Engel, Maple Grove, MN (US); Tobin Dale Rasmusson, Bloomington, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/344,877

(22) Filed: Nov. 7, 2016

(51) Int. Cl.

| | |
|---|---|
| ***E01C 19/22*** | (2006.01) |
| ***E01C 23/14*** | (2006.01) |
| ***E01C 19/48*** | (2006.01) |
| ***E01C 19/42*** | (2006.01) |

(52) U.S. Cl.
CPC ..... *E01C 19/48* (2013.01); *E01C 19/42* (2013.01); *E01C 2301/10* (2013.01)

(58) Field of Classification Search
CPC ..... E01C 19/22; E01C 19/42; E01C 23/14
USPC ..... 404/95, 96, 118
See application file for complete search history.

(56) References Cited

U.S. PATENT DOCUMENTS

| | | | | |
|---|---|---|---|---|
| 2,351,592 | A | 6/1944 | Barber | |
| 3,557,672 | A * | 1/1971 | Shurtz | E01C 19/4873 404/118 |
| 5,308,190 | A * | 5/1994 | Raymond | E01C 19/48 404/118 |
| 5,397,199 | A | 3/1995 | Frampton et al. | |
| 6,022,170 | A * | 2/2000 | Rower | E01C 19/48 404/118 |
| 6,390,727 | B1 * | 5/2002 | Guntert, Jr. | E01C 23/04 404/88 |
| 6,984,089 | B1 | 1/2006 | Colvard | |
| 9,340,365 | B2 | 5/2016 | Erdtmann et al. | |

FOREIGN PATENT DOCUMENTS

| | | | |
|---|---|---|---|
| JP | 2010090552 | | 4/2010 |
| SU | 444654 | * | 6/1975 |

* cited by examiner

*Primary Examiner* — Gary Hartmann

(57) ABSTRACT

A screed assembly for a paving machine includes a main screed unit having a first section and a second section. A hinge assembly located above the main screed unit pivotally couples the first section with the second section. The first section and the second section rotate around a horizontal axis passing through the hinge assembly. A seal member located between the hinge assembly and the main screed unit covers a gap defined between the first section and the second section below the hinge assembly such that the seal member covers the gap and laterally extends beyond the gap above the first section and the second section. A pair of heating components attached to the first section and the second section heats the first section and the second section.

20 Claims, 5 Drawing Sheets

SCREED ASSEMBLY FOR PAVING MACHINE

TECHNICAL FIELD

The present disclosure relates to a paving machine. More specifically, the present disclosure relates to a screed assembly for the paving machine.

BACKGROUND

A paving machine, such as an asphalt paver, is a self-propelled construction machine designed to receive, convey, distribute, profile and partially compact the asphalt material. The paving machine accepts asphalt material that is heated to an appropriate temperature for flow and even spreading into a receiving hopper at front of the paving machine. The asphalt material in the hopper is conveyed to rear of the paving machine with conveyors positioned at a bottom of the hopper.

The asphalt material conveyed from the hopper is distributed along width of an intended ribbon or mat by means of two opposing screws or spreading conveyors or augers, and a screed assembly profiles and compacts the asphalt material into a mat on the paving surface. The screed assembly may include two flat sections coupled together at a hinge so as to accommodate for a crowning motion of the paving machine in order to impart required slope to the paving surface. During the paving process, the screed assembly must be heated so that the hot paving material does not stick to a bottom surface of the screed assembly as the screed assembly passes over and compacts the mat.

As the paving material gets heated, viscosity of the paving material decreases and the paving material is able to flow easily and can be distributed on the paving surface effectively. If the screed assembly will not be heated to an adequate temperature, the hot paving material coming in contact with the screed assembly will get cooled, and as a result will stick to the screed assembly. The screed assembly has electrical heating elements that heat the screed assembly to the necessary temperature for paving. The heating elements may be attached to the screed assembly through mechanical fasteners and can be easily replaced after being worn out.

However, while the screed assembly passes over and compacts the mat, the hot paving material may enter the screed assembly through a gap between the two sections at the hinge. The hot asphalt may also stick to the mechanical fasteners holding the heating elements and may pose problems in easy removal of the heating elements for replacement later. It may also damage the heating elements in process of removal. Thus, an improved screed assembly is required to solve the aforementioned problem.

SUMMARY

In an aspect of the present disclosure, a screed assembly for a paving machine includes a main screed unit having a first section and a second section. The screed assembly includes a hinge assembly located above the main screed unit which pivotally couples the first section with the second section. The first section and the second section rotate around a horizontal axis passing through the hinge assembly. The screed assembly includes a seal member located between the hinge assembly and the main screed unit covering a gap defined between the first section and the second section below the hinge assembly, such that the seal member covers the gap and laterally extends beyond the gap above the first section and the second section. The screed assembly further includes a pair of heating components attached to the first section and the second section. The pair of heating components heats the first section and the second section.

In another aspect of the present disclosure, a paving machine is provided. The paving machine includes a tractor portion, a hopper adapted to receive a paving material, a conveyor, an auger and a screed assembly coupled to the tractor portion. The screed assembly includes a main screed unit having a first section and a second section. The screed assembly includes a hinge assembly located above the main screed unit which pivotally couples the first section with the second section. The first section and the second section rotate around a horizontal axis passing through the hinge assembly. The screed assembly includes a seal member located between the hinge assembly and the main screed unit covering a gap defined between the first section and the second section below the hinge assembly, such that the seal member covers the gap and laterally extends beyond the gap above the first section and the second section. The screed assembly further includes a pair of heating components attached to the first section and the second section. The pair of heating components heats the first section and the second section.

In yet another aspect of the present disclosure, a screed assembly for a paving machine includes a main screed unit having a first section and a second section. The screed assembly includes a hinge assembly located above the main screed unit which pivotally couples the first section with the second section. The first section and the second section rotate around a horizontal axis passing through the hinge assembly. The screed assembly includes a seal member located between the hinge assembly and the main screed unit covering a gap defined between the first section and the second section below the hinge assembly, such that the seal member covers the gap and laterally extends beyond the gap above the first section and the second section. The screed assembly includes a pair of heating components attached to the first section and the second section. The pair of heating components heats the first section and the second section. The screed assembly includes a wear bar coupled to the screed assembly at a first end of the gap. The wear bar restricts movement of the seal member along the gap towards the first end. The screed assembly further includes a wiper coupled to the screed assembly at a second end of the gap. The wiper restricts movement of the seal member along the gap towards the second end.

DETAILED DESCRIPTION

Figure 1:
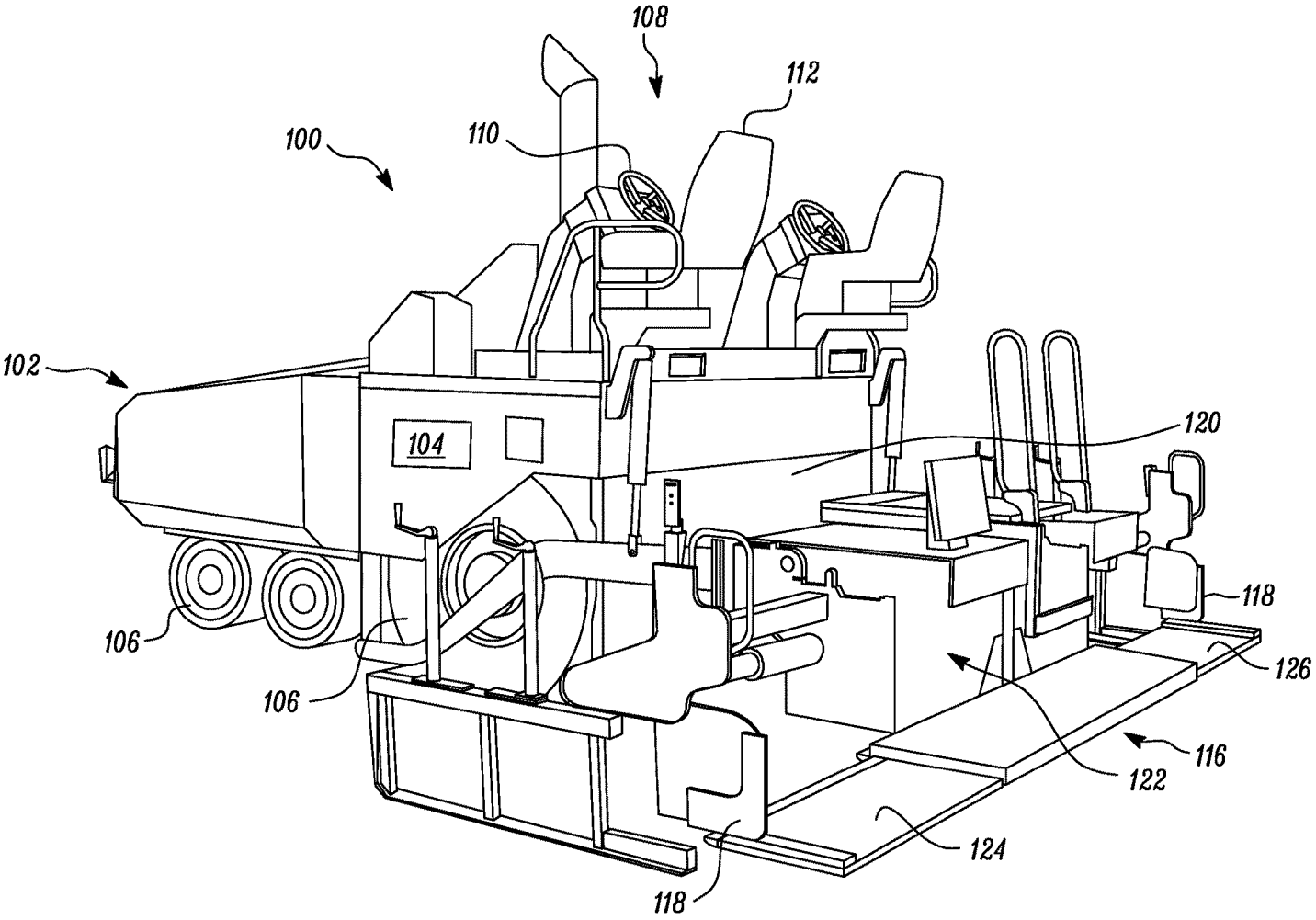
FIG. 1 shows a perspective view of a paving machine having a screed assembly, in accordance with an embodiment of the present disclosure.

Wherever possible, the same reference numbers will be used throughout the drawings to refer to same or like parts. An exemplary embodiment of a paving machine 100 is shown generally in FIG. 1. The paving machine 100, which may also be referred to as an asphalt paver, may be any machine used to distribute a layer of paving material on a surface of a roadway or other area. The paving machine 100 generally includes a tractor portion 102 including a power source 104, such as an internal combustion engine. The paving machine 100 further includes ground engaging elements 106, some or all of which may be powered by the power source 104. Although, the ground engaging elements 106 are illustrated as wheels, it should be contemplated that the ground engaging elements 106 may as well be tracks, or a combination of wheel and tracks or any other known mechanism for propelling the paving machine 100 on a paving surface.

The paving machine 100 further includes an operator control station 108. The operator control station 108 includes a steering wheel 110 and an operator seat 112 which is used by an operator to steer the paving machine 100. The operator control station 108 may further include a user interface (not shown) having controls for various parts and subsystems of the paving machine 100. The tractor portion 102 also supports various other components and systems, including a hopper, an auger (not shown) for receiving the paving material.

A conveyor (not shown) may also be supported on the tractor portion 102 and may convey the paving material received within the hopper to a screed assembly 116, coupled with the paving machine 100, such as via tow arms 118, at a rear portion 120 of the tractor portion 102. The screed assembly 116 distributes and provides partial compaction of the paving material into a mat on the desired paving surface. The screed assembly 116 of the paving machine 100 may also include additional components and systems, such as, for example, leveling arms, vibrators, tamper bars, sensors, and controllers, as are known to those skilled in the art.

The screed assembly 116 may generally include a main screed unit 122, a first extendible frame portion 124, and a second extendible frame portion 126. Each of the first and second extendible frame portions 124, 126 may be mounted on the main screed unit 122 and may be expandable sideways. The first and second extendible frame portions 124, 126 may provide a walkway for an operator to have a better access to the surface being paved in order to assess quality of the paving operation or any other purpose for that matter. According to a specific example, the first and second extendible frame portions 124, 126 may be hydraulically extendible, or expandable, using respective extension cylinders, as is known by those skilled in the art. In particular, the first and second extendible frame portions 124, 126 may be expanded or shortened to effectively extend or shorten an adjustable paving width. According to some embodiments, each of the first and second extendible frame portions 124, 126 may be independently adjustable. It should be noted that screed assembly 116 may alternately consist of a main screed with fixed width frames attached to the main screed for the purpose of attaining greater paving widths. The fixed width frames may act as extensions to the main screed. A combination of the main screed and the extensions may cover additional area on the surface being paved as compared to the main screed alone. Dimensions of the extensions may vary as per the application area of the paving machine 100.

Figure 2:
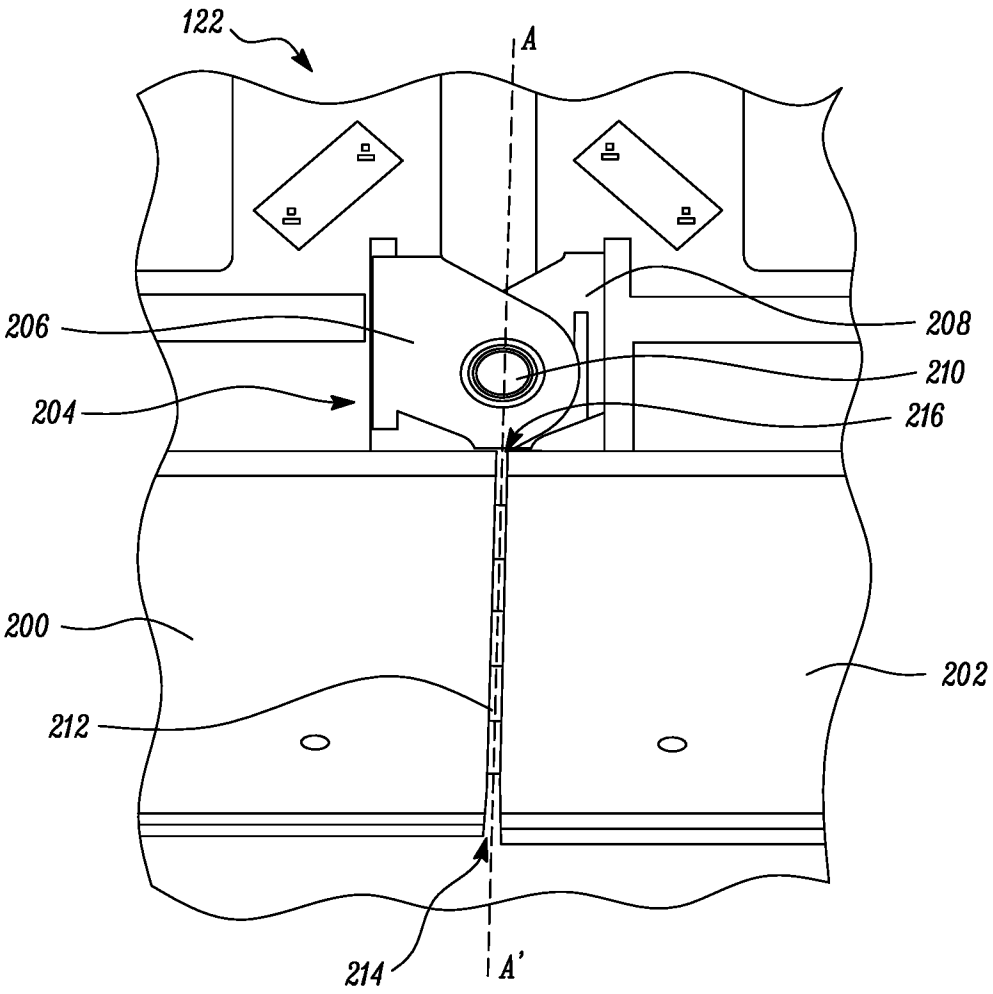
FIG. 2 shows a portion of the screed assembly of FIG. 1, in accordance with an embodiment of the present disclosure.

FIG. 2 illustrates a portion of the main screed unit 122. The main screed unit 122 includes a first section 200 and a second section 202. The first section 200 and the second section 202 are coupled to each other with a hinge assembly 204. For exemplary purposes, the hinge assembly 204 includes a first part 206 and a second part 208. The first part 206 and the second part 208 of the hinge assembly 204 are complementary parts interconnected through a mechanical fastener 210 passing through both the first and second parts 206, 208 such that the first and second parts 206, 208 can rotate about the mechanical fastener 210. Each of the first and second parts 206, 208 are coupled to the first section 200 and the second section 202 of the main screed unit 122 respectively. Therefore, the first section 200 and the second 202 can also rotate about the hinge assembly 204. The hinge assembly 204 may also be any other conventional type of hinge assembly which may be suitable to the need of the present disclosure.

The hinge assembly 204 is located above the main screed unit 122. The first section 200 and the second section 202 can rotate relative to each other about an imaginary horizontal axis A-A' passing through the hinge assembly 204. The first section 200 and the second section 202 define a gap 212 between the first section 200 and the second section 202 below the hinge assembly 204. The gap 212 has a first end 214 and a second end 216 and extends along the axis A-A' between the first section 200 and the second section 202 of the main screed unit 122. Dimensions of the gap 212 may vary as per machine configuration, paving requirements and make and model of the paving machine 100 for different applications.

Figure 3:
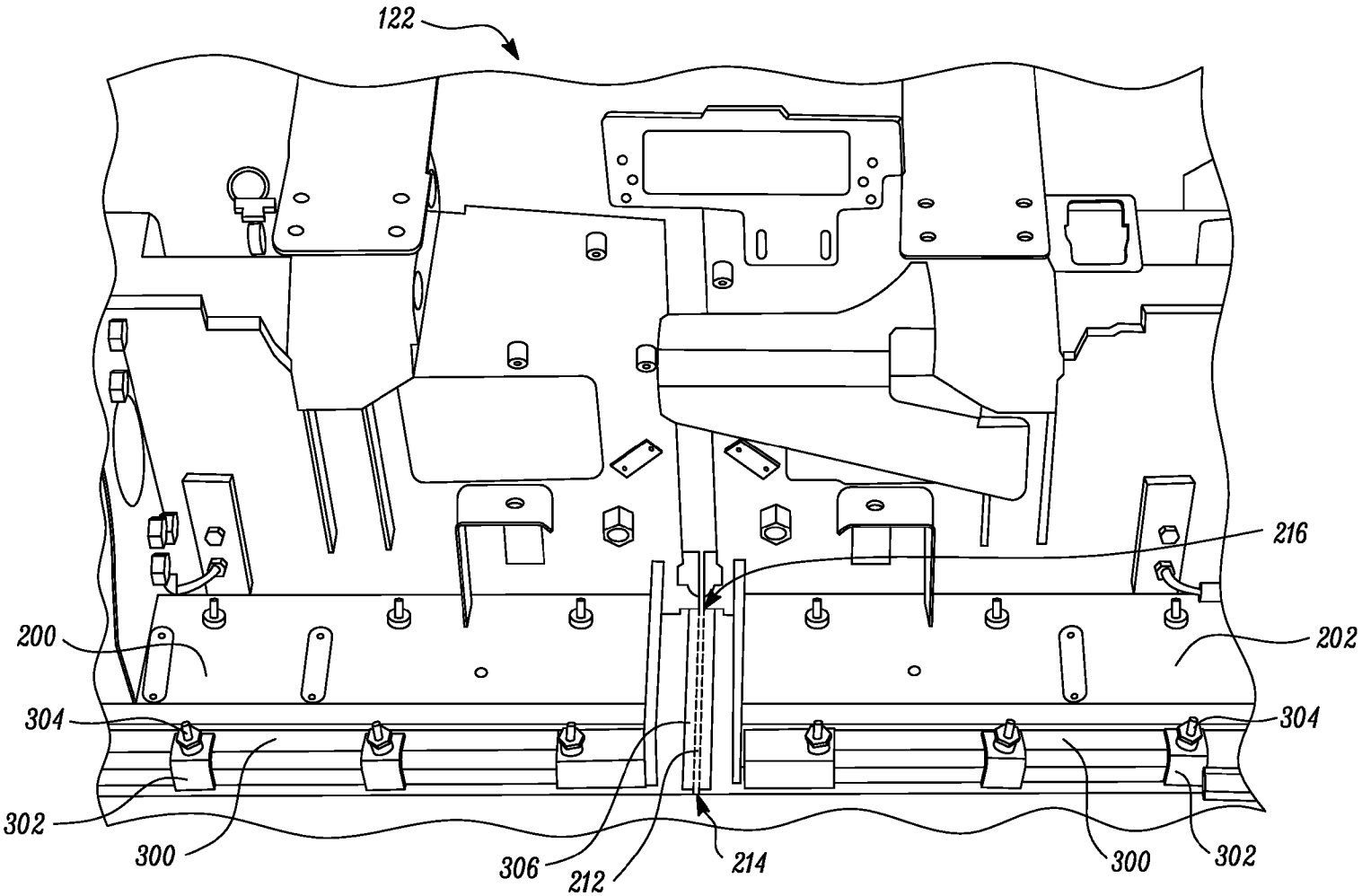
FIG. 3 shows a rear perspective view of the screed assembly, in accordance with an embodiment of the present disclosure.

FIG. 3 shows further details of the screed assembly 116 without the hinge assembly 204. It should be noted that the hinge assembly 204 has been taken out only for illustrative purposes to provide a better view of the screed assembly 116, and the hinge assembly 204 is an integral part of the present disclosure. The screed assembly 116 functions to spread paving material distributed by the paving machine 100 onto the paving surface. In order to achieve optimum workability of the paving material, the temperature of the screed assembly 116 should be maintained within a predetermined temperature range. A set of heating components 300 maintains the temperature of the screed assembly 116 within the required temperature range as per the need of the application. Separate heating components 300 are coupled to the first section 200 and the second section 202 of the main screed unit 122. The heating components 300 are coupled to the first section 200 and the second section 202 of the main screed unit 122 by any suitable mechanical fastening means.

In the illustrated embodiment, the heating components 300 are clamped with the first section 200 and the second section 202 of the main screed unit 122 through a bracket 302 and a fastener 304. The fastener 304 may be any suitable mechanical fastener such as a bolt etc. It should be contemplated that any other fastening means may also be used as per the need of the application area of the paving machine 100. The heating components 300 may be connected to a control system (not shown) which may regulate the temperature of the heating components 300 to control the temperature ranges of the main screed unit 122. Various other types of heating elements may be used as well in place of the heating components 300 which may suit the need of the present disclosure.

It should be contemplated that the main screed unit 122 includes the first section 200 and the second section 202 coupled to each other through the hinge assembly 204 to allow a crowning/bending motion of the screed assembly 116 in order to impart required slope to the surface being paved. The crowning/bending motion refers to a bending of the first section 200 and the second section 202 of the main screed unit 122 about the axis A-A' so that the first section 200 and the second section 202 impart a slope and maintain contact with the surface being paved. Structure of the main screed unit 122 as a combination of the first section 200 and the second section 202 instead of a single screed allows the heating components 300 to remain in contact with the first section 200 and the second section 202 of the main screed unit 122 at all times irrespective of the crowning/bending motion of the screed assembly 116.

Figure 4:
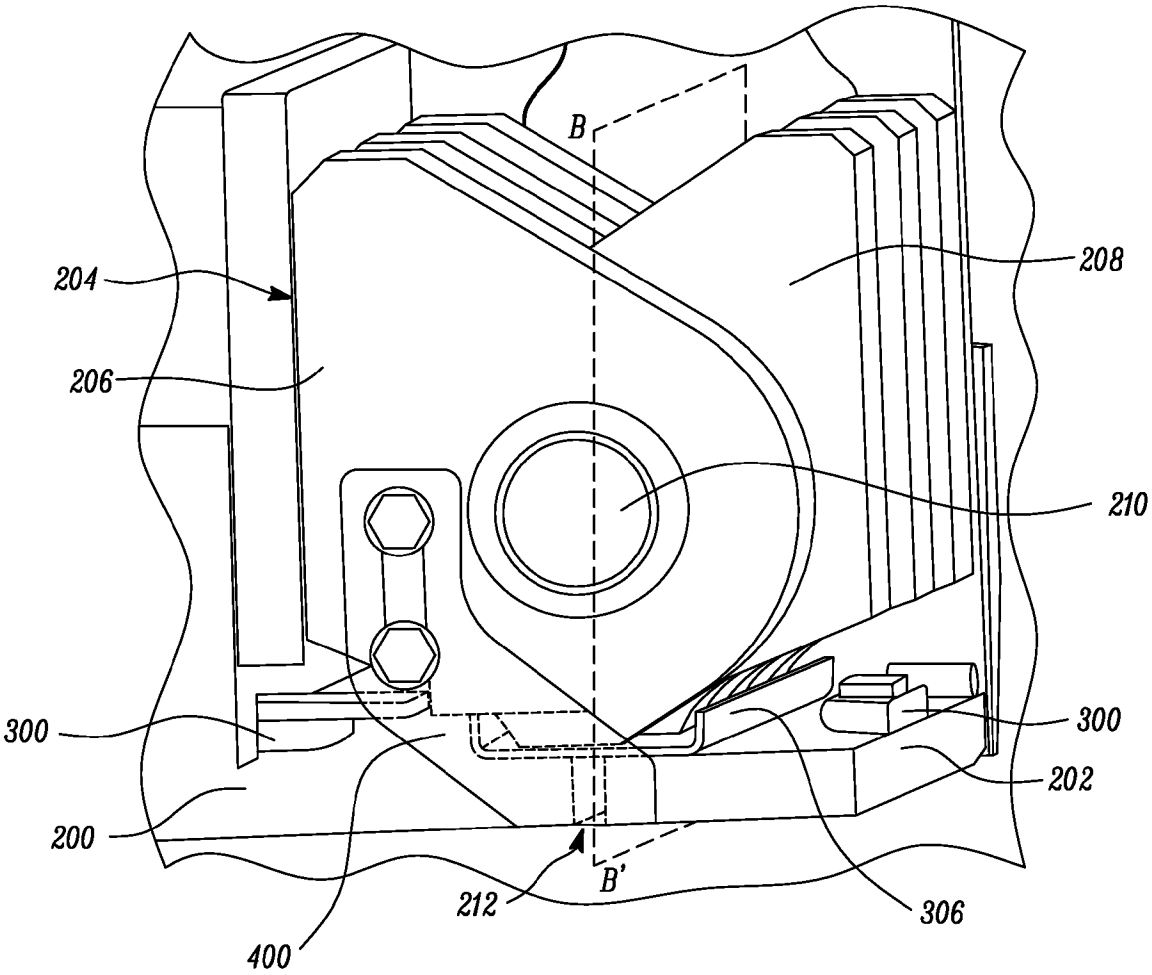
FIG. 4 shows a rear view of the screed assembly, in accordance with an embodiment of the present disclosure.

The screed assembly 116 further includes a seal member 306. The seal member 306 is located below the hinge assembly 204. The seal member 306 covers the gap 212 between the first section 200 and the second section 202 and laterally extends beyond the gap 212 above the first section 200 and the second section 202. FIG. 4 illustrates the seal member 306 located below the hinge assembly 204 and covering the gap 212 between the first section 200 and the second section 202 of the main screed unit 122. The seal member 306 is a U-shaped plate extending from the first end 214 to the second end 216 of the gap 212. The seal member 306 covers the gap 212 and inhibits any debris, or dust or asphalt ingress through the gap 212 into the screed assembly 116. The seal member 306 is made of a flexible material for e.g. steel or any other material which may be suitable as per the scope of the present disclosure.

As the seal member 306 is U-shaped, sideways movement of the seal member 306 is restricted, and the seal member 306 does not move an appreciable distance laterally and stays in place. Longitudinal movement of the seal member 306 is restricted on the first end 214 of the gap 212 by a wiper 400. The wiper 400 is coupled to the screed assembly 116 towards the first end 214 of the gap 212.

As there is the gap 212 between the first section 200 and the second section 202 of the main screed unit 122, it may be possible that a portion of asphalt mat which is coming below the gap 212 may not get compressed by same amount of force as compared to a portion of the asphalt mat coming below the first section 200 and the second section 202 of the main screed unit 122. This may lead to formation of an extrusion in middle of the asphalt mat being paved. The wiper 400 is provided to level this extrusion as the screed assembly 116 moves along the paving surface. The wiper 400 keeps the seal member 306 in place and ensures that there is no movement of the seal member 306 towards the first end 214 of the gap 212. An imaginary plane B-B' passing through the hinge assembly 116 as well as the gap 212 between the first section 200 and the second section 202 of the main screed unit 122 divides the screed assembly 116 in two symmetrical parts. The plane B-B' is perpendicular to the paving surface.

Figure 5:
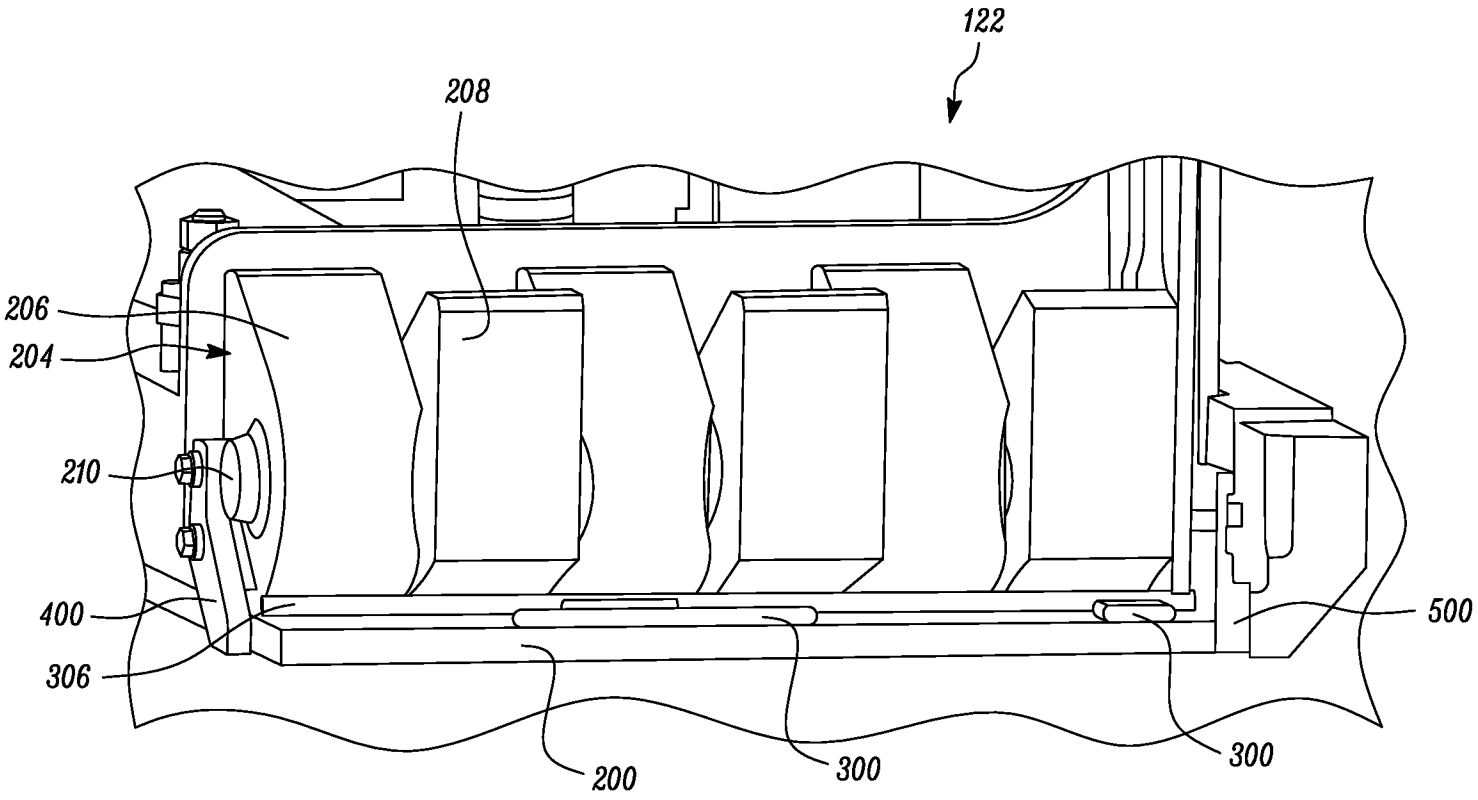
FIG. 5 shows a sectional view of the screed assembly taken along plane B-B', in accordance with an embodiment of the present disclosure.

FIG. 5 shows a sectional view of the screed assembly 116 taken along the plane B-B' of FIG. 4. As illustrated the seal member 306 extends from the first end 214 to the second end 216 of the gap 212. Movement of the seal member 306 along the gap 212 is restricted at the second end 216 of the gap 212 by a wear bar 500. The wear bar 500 is coupled to the screed assembly 116 towards the second end 216 of the gap 212 through any mechanical fastening means suitable to the scope of the present disclosure. The wear bar 500 keeps the seal member 306 in place towards the second end 216 of the gap 212 and ensures that there is no movement of the seal member 306 towards the second end 216 of the gap 212. Restriction of the sideways movement of the seal member 306 due to the U-shape of the seal member 306, and restriction of the movement of the seal member 306 along the gap 212 at the first end 214 by the wiper 400 and at the second end 216 by the wear bar 500 ensures that the gap 212 is covered at all times.

INDUSTRIAL APPLICABILITY

The present disclosure provides an improved arrangement for the screed assembly 116 of the paving machine 100. The screed assembly 116 includes the main screed unit 122. The main screed unit 122 includes the first section 200 and the second section 202 pivotally coupled to each other through the hinge assembly 204. The gap 212 is defined between the first section 200 and the second section 202 of the main screed unit 122 below the hinge assembly 204. The seal member 306 is located below the hinge assembly 204. The seal member 306 covers the gap 212 between the first section 200 and the second section 202 and laterally extends beyond the gap 212 above the first section 200 and the second section 202. The seal member 306 inhibits ingress of any dust, debris, concrete, or asphalt material from the gap 212 in to the screed assembly 116.

As heated asphalt etc. can no longer enter the screed assembly 116 through the gap 212, it facilitates easy removal of the heating components 300. Removable or replaceable heating components 300 can be used without facing any problems while replacement. Further, any damages to various parts of the screed assembly 116 due to coming in contact with heated asphalt, debris, dust etc. are avoided. Maintenance and service procedures of the screed assembly 116 can be carried out more easily as compared to the prior art arrangements. Also, frequent downtimes due to any such problems are avoided and the heating components 300 can be periodically serviced or replaced to ensure that the screed assembly 116 operates within acceptable temperature ranges.

The seal member 306 stays in place and does not move laterally or along the gap 212. The movement of the seal member 306 in the lateral direction is restricted by the U-shape of the seal member 306. The wiper 400 and the wear bar 500 restrict the movement of the seal member 306 along the gap 212 towards the first end 214 and the second end 216 respectively. Due to the shape and placement of the seal member 306 in the screed assembly 116, the seal member 306 does not need any additional coupling arrangements or fasteners etc. to keep the seal member 306 fixed in place. This provides for easy replacement of the seal member 306, once the seal member 306 has worn out. Further, as the seal member 306 is made of a flexible material, for e.g. steel, the seal member 306 may adjust against any vibrations etc. which may arise due to the operation of the paving machine 100 or otherwise. Also, the seal member 306 fits in the designated place effectively and covers the gap 212 efficiently against any material ingress.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A screed assembly for a paving machine, the screed assembly comprising:

a main screed unit having a first section and a second section;

a hinge assembly disposed above the main screed unit, the hinge assembly pivotally coupling the first section with the second section, the first section and the second section adapted to rotate around a horizontal axis passing through the hinge assembly;

a seal member disposed between the hinge assembly and the main screed unit, the seal member adapted to cover a gap defined between the first section and the second section below the hinge assembly such that the seal member covers the gap and laterally extends beyond the gap above the first section and the second section; and a pair of heating components attached to the first section and the second section, the pair of heating components adapted to heat the first section and the second section.

2. The screed assembly of claim 1, wherein the seal member is a U-shaped plate.

3. The screed assembly of claim 2, wherein a sideways movement of the seal member is restricted due to the U-shape of the seal member.

4. The screed assembly of claim 1, wherein the screed assembly further includes a wear bar coupled to the screed assembly at a first end of the gap, the wear bar adapted to restrict movement of the seal member towards the first end, along the gap.

5. The screed assembly of claim 1, wherein the screed assembly further includes a wiper coupled to the screed assembly at a second end of the gap, the wiper adapted to restrict movement of the seal member towards the second end, along the gap.

6. The screed assembly of claim 1, wherein the seal member is made of a flexible metallic material.

7. The screed assembly of claim 1, wherein the pair of heating components coupled to the first section and the second section is adapted to heat the first section and the second section.

8. The screed assembly of claim 1, wherein the seal member is adapted to stop material ingression through the gap between the first section and the second section.

9. A paving machine comprising:

a tractor portion;

a hopper adapted to receive a paving material;

a conveyor;

an auger;

a screed assembly coupled to the tractor portion, the screed assembly comprising:

a main screed unit having a first section and a second section;

a hinge assembly disposed above the main screed unit, the hinge assembly pivotally coupling the first section with the second section, the first section and the second section adapted to rotate around a horizontal axis passing through the hinge assembly;

a seal member disposed between the hinge assembly and the main screed unit, the seal member adapted to cover a gap defined between the first section and the second section below the hinge assembly, such that the seal member covers the gap and laterally extends beyond the gap above the first section and the second section; and a pair of heating components attached to the first section and the second section, the pair of heating components adapted to heat the first section and the second section.

10. The paving machine of claim 9, wherein the seal member is a U-shaped plate.

11. The paving machine of claim 9, wherein a sideways movement of the seal member is restricted due to the U-shape of the seal member.

12. The paving machine of claim 9, wherein the screed assembly further includes a wear bar coupled to the screed assembly at a first end of the gap, the wear bar adapted to restrict movement of the seal member towards the first end, along the gap.

13. The paving machine of claim 9, wherein the screed assembly further includes a wiper coupled to the screed assembly at a second end of the gap, the wiper adapted to restrict movement of the seal member towards the second end, along the gap.

14. The paving machine of claim 9, wherein the seal member is made of a flexible metallic material.

15. The paving machine of claim 9, wherein the pair of heating components coupled to the first section and the second section is adapted to heat the first section and the second section.

16. The paving machine of claim 9, wherein the seal member is adapted to stop material ingression through the gap between the first section and the second section.

17. A screed assembly for a paving machine, the screed assembly comprising:

a main screed unit having a first section and a second section;

a hinge assembly disposed above the main screed unit, the hinge assembly pivotally coupling the first section with the second section, the first section and the second section adapted to rotate around a horizontal axis passing through the hinge assembly;

a U-shaped seal member disposed between the hinge assembly and the main screed unit, the seal member adapted to cover a gap defined between the first section and the second section of the main screed unit below the hinge assembly, such that the seal member covers the gap and laterally extends beyond the gap above the first section and the second section;

a pair of heating components attached to the first section and the second section, the pair of heating components adapted to heat the first section and the second section;

a wear bar coupled to the screed assembly at a first end of the gap, the wear bar adapted to restrict movement of the seal member towards the first end, along the gap; and a wiper coupled to the screed assembly at a second end of the gap, the wiper adapted to restrict movement of the seal member towards the second end, along the gap.

18. The screed assembly of claim 17, wherein the seal member is made of a flexible metallic material.

19. The screed assembly of claim 17, wherein the seal member is adapted to stop material ingression through the gap between the first section and the second section.

20. The screed assembly of claim 17, wherein the pair of heating components coupled to the first section and the second section is adapted to heat the first section and the second section.

* * * * *